US010234164B2

(12) United States Patent
Takeuchi et al.

(10) Patent No.: US 10,234,164 B2
(45) Date of Patent: Mar. 19, 2019

(54) AIR CONDITIONING APPARATUS

(71) Applicant: DAIKIN INDUSTRIES, LTD., Osaka-shi, Osaka (JP)

(72) Inventors: Tomohisa Takeuchi, Chonburi (TH); Satoshi Kawano, Oostende (BE); Shinya Matsuoka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 226 days.

(21) Appl. No.: 15/117,402

(22) PCT Filed: Feb. 17, 2015

(86) PCT No.: PCT/JP2015/054227

§ 371 (c)(1),
(2) Date: Aug. 8, 2016

(87) PCT Pub. No.: WO2015/125763

PCT Pub. Date: Aug. 27, 2015

(65) Prior Publication Data

US 2016/0348933 A1 Dec. 1, 2016

(30) Foreign Application Priority Data

Feb. 21, 2014 (JP) ..... 2014-031771

(51) Int. Cl.
*F24F 1/50* (2011.01)
*F24F 11/83* (2018.01)
(Continued)

(52) U.S. Cl.
CPC ..... *F24F 11/83* (2018.01); *F24F 1/50* (2013.01); *F25B 49/005* (2013.01); *F24F 11/36* (2018.01);
(Continued)

(58) Field of Classification Search
USPC ..... 62/183
See application file for complete search history.

(56) References Cited

U.S. PATENT DOCUMENTS 4,277,439 A * 7/1981 Yasuda ..... G01R 17/10 324/71.5
4,951,632 A * 8/1990 Yakuwa ..... F02D 41/1495 123/688
(Continued)

FOREIGN PATENT DOCUMENTS

CN 202133061 U 2/2012
JP 6-264897 A 9/1994
(Continued)

OTHER PUBLICATIONS

International Search Report of corresponding PCT Application No. PCT/JP2015/054227 dated May 19, 2015.
(Continued)

*Primary Examiner* — Henry T Crenshaw
(74) *Attorney, Agent, or Firm* — Global IP Counselors, LLP

(57) ABSTRACT

An air conditioning apparatus includes a casing, a heat exchanger and a blower. In the casing, an intake port is formed and a blow-off port is formed in a top surface section. The heat exchanger and the blower are housed in the casing. The blower is caused to rotate while a flammable refrigerant flows to the heat exchanger during an operation, an intake air is taken into the casing from the intake port, a heat exchange is carried out between the flammable refrigerant and the intake air in the heat exchanger, and the heat-exchanged air is blown out from the blow-off port to an exterior of the casing. A first refrigerant sensor that detects the flammable refrigerant is disposed on a downwind side of the heat exchanger inside the casing.

15 Claims, 5 Drawing Sheets

(51) Int. Cl.

| | |
|---|---|
| ***F25B 49/00*** | (2006.01) |
| *F25B 13/00* | (2006.01) |
| *F24F 11/36* | (2018.01) |

(52) U.S. Cl.

CPC ..... *F25B 13/00* (2013.01); *F25B 2400/12* (2013.01); *F25B 2500/222* (2013.01); *F25B 2600/111* (2013.01)

(56) References Cited

U.S. PATENT DOCUMENTS

| | | | | | |
|---|---|---|---|---|---|
| 5,797,358 | A * | 8/1998 | Brandt | F24H 9/2035 | 122/448.1 |
| 6,073,455 | A * | 6/2000 | Tachigori | F25B 49/005 | 62/129 |
| 6,308,572 | B1 * | 10/2001 | Ishikawa | G01N 29/024 | 73/24.01 |
| 6,857,280 | B1 * | 2/2005 | Yamanaka | B60H 1/00978 | 62/205 |
| 2003/0213254 | A1 * | 11/2003 | Koo | F25B 13/00 | 62/174 |
| 2006/0237315 | A1 * | 10/2006 | Matsuo | F02D 41/1454 | 204/424 |
| 2009/0032113 | A1 * | 2/2009 | Cox | B60H 1/00978 | 137/68.13 |
| 2011/0277541 | A1 * | 11/2011 | Kadle | B60H 1/00978 | 73/40.7 |
| 2013/0174592 | A1 * | 7/2013 | Yamashita | F24F 1/06 | 62/126 |
| 2013/0192283 | A1 * | 8/2013 | Yamashita | F24F 1/32 | 62/126 |
| 2014/0367069 | A1 | 12/2014 | Yamaguchi et al. | | |

FOREIGN PATENT DOCUMENTS

| | | | |
|---|---|---|---|
| JP | 10-299691 | A | 11/1998 |
| JP | 10299691 | A * | 11/1998 |
| JP | 2001-208392 | A | 8/2001 |
| JP | 2001208392 | A * | 8/2001 |
| JP | 2002-98393 | A | 4/2002 |
| JP | 2005-16822 | A | 1/2005 |
| JP | 2009-79870 | A | 4/2009 |
| JP | 2009079870 | A * | 4/2009 |
| JP | 2012-215337 | A | 11/2012 |
| JP | 2013-190906 | A | 9/2013 |
| WO | 2013/129123 | A1 | 9/2013 |

OTHER PUBLICATIONS

European Search Report of corresponding EP Application No. 15 75 1627.9 dated Jan. 23, 2018.

International Preliminary Report of corresponding PCT Application No. PCT/JP2015/054227 dated Aug. 23, 2016.

European Search Report of corresponding Divisional EP Application No. 18 16 9308.6 dated Aug. 1, 2018.

* cited by examiner

AIR CONDITIONING APPARATUS

CROSS-REFERENCE TO RELATED APPLICATIONS

This U.S. National stage application claims priority under 35 U.S.C. § 119(a) to Japanese Patent Application No, 2014-031771, filed in Japan on Feb. 21, 2014, the entire contents of which are hereby incorporated herein by reference.

TECHNICAL FIELD

The present invention relates to an air conditioning apparatus, and particularly relates to an air conditioning apparatus in which a flammable refrigerant is used.

BACKGROUND ART

Conventionally, there are air conditioning apparatuses that use R32 or other flammable refrigerants. Such an air conditioning apparatus is proposed in Japanese Patent Application Laid-open No. 2002-98393 in which a refrigerant sensor is provided to an outer surface of a lower section of a casing of a floor-type indoor unit to detect a leakage of the flammable refrigerant.

SUMMARY

The arrangement of the refrigerant sensor in Japanese Patent Application Laid-open No. 2002-98393 takes into account the fact that a configuration is adopted to make it possible to detect that flammable refrigerant has leaked indoors. However, the flammable refrigerant is dispersed by the flow of an air from a blower during an operation of the air conditioning apparatus, and there is therefore a possibility that the leakage of the flammable refrigerant cannot be rapidly detected.

An object of the present invention is to make it possible to rapidly detect the leakage of the refrigerant during the operation in the air conditioning apparatus that uses the flammable refrigerant.

An air conditioning apparatus according to a first aspect of the present invention has a casing in which an intake port is formed and a blow-off port is formed in atop surface section, and a heat exchanger and a blower housed in the casing, and is configured so that the blower is caused to rotate while a flammable refrigerant flows to the heat exchanger during an operation, an air is taken into the casing from the intake port, a heat exchange is carried out between the flammable refrigerant and the intake air in the heat exchanger, and the heat-exchanged air is blown out from the blow-off port to an exterior of the casing. A first refrigerant sensor for detecting the flammable refrigerant is disposed on a downwind side of the heat exchanger inside the casing.

A refrigerant sensor is preferably arranged in a position in which the flow of the air from the blower is concentrated and the majority of the leaked flammable refrigerant passes inside the casing in order to allow the leakage of the flammable refrigerant during the operation to be rapidly detected.

In view of this fact, according to the aspect described above, the first refrigerant sensor is provided to the downwind side of the heat exchanger in which the flammable refrigerant may possibly leak inside the casing.

The leakage of the flammable refrigerant during the operation can thereby be rapidly detected.

An air conditioning apparatus according to a second aspect of the present invention is the air conditioning apparatus according to the first aspect of the present invention, wherein the blower is arranged on the downwind side of the heat exchanger, and the first refrigerant sensor is arranged on an upwind side of the blower.

According to the aspect described above, the heat exchanger and the blower are arranged in the sequence of the heat exchanger and the blower with respect to the flow of the air inside the casing, and the first refrigerant sensor is arranged on the downwind side of the heat exchanger and on the upwind side of the blower. Accordingly, the detection of the flammable refrigerant by the first refrigerant sensor can suppress the influence of the atmosphere outside the casing in which the flammable refrigerant is dispersed.

It is thereby possible to increase the precision for detecting the leakage of the flammable refrigerant.

An air conditioning apparatus according to a third aspect of the present invention is the air conditioning apparatus according to the second aspect of the present invention, wherein the first refrigerant sensor is arranged in a position nearer to the blower than to the heat exchanger.

An air conditioning apparatus according to a fourth aspect of the present invention is the air conditioning apparatus according to the first aspect of the present invention, wherein the blower is arranged on the downwind side of the heat exchanger, and the first refrigerant sensor is arranged in a position nearer to the blower than to the heat exchanger.

According to the aspects described above, the first refrigerant sensor is arranged in the position nearer to the blower than to the heat exchanger. Accordingly, the degree of concentration of the airflow from the blower can be made greater than when the first refrigerant sensor is arranged in a position near the heat exchanger.

It is thereby possible to increase the precision for detecting the leakage of the flammable refrigerant.

An air conditioning apparatus according to a fifth aspect of the present invention is the air conditioning apparatus according to any of the first to fourth aspects of the present invention, wherein the blower has a propeller-type impeller, and the first refrigerant sensor is arranged in a vicinity of an external peripheral edge of the impeller.

According to the aspect described above, the first refrigerant sensor is arranged in the vicinity of the external peripheral edge of the propeller-type impeller. Accordingly, the detection of the flammable refrigerant by the first refrigerant sensor can be carried out in the position in which the velocity of the air inside the casing is greatest.

It is thereby possible to increase the precision for detecting the leakage of the flammable refrigerant.

An air conditioning apparatus according to a sixth aspect of the present invention is the air conditioning apparatus according to any of the first to fifth aspects of the present invention, wherein the intake port is formed below the blow-off port among a side surface section of the casing, and a second refrigerant sensor for detecting the flammable refrigerant is furthermore provided to a bottom surface section of the casing.

According to the aspect described above, a structure is used in which the intake port is formed below the blow-off port among the side surface section of the casing, i.e., a top-blow-type structure in which the air is taken into the casing from below and the air is blown to the exterior of the casing from above. Accordingly, when the flammable refrigerant has leaked during the operation stoppage, the flammable refrigerant, which has a high specific gravity, accumulates in the vicinity of the bottom surface section of the casing, and the first refrigerant sensor provided on the downwind side of the heat exchanger is not able to rapidly detect the leakage of the flammable refrigerant during the operation stoppage.

In view of this situation, the second refrigerant sensor is furthermore provided to the bottom surface section of the casing for the case in which the casing is the top-blow-type structure.

The leakage of the flammable refrigerant during the operation stoppage can thereby be rapidly detected.

An air conditioning apparatus according to a seventh aspect of the present invention is the air conditioning apparatus according to any of the first to fifth aspects of the present invention, wherein when the first refrigerant sensor has detected the flammable refrigerant, the blower is caused to rotate in a state in which the flammable refrigerant is not allowed to flow to the heat exchanger.

An air conditioning apparatus according to an eight aspect of the present invention is the air conditioning apparatus according to the sixth aspect of the present invention, wherein when the first refrigerant sensor or the second refrigerant sensor has detected the flammable refrigerant, the blower is caused to rotate in a state in which the flammable refrigerant is not allowed to flow to the heat exchanger.

According to the aspects described above, when the first refrigerant sensor or the second refrigerant sensor has detected the flammable refrigerant, the blower is caused to rotate in the state in which the flammable refrigerant is not allowed to flow to the heat exchanger. In other words, when the leakage of the flammable refrigerant has been detected during the operation, the compressor is stopped or other action is taken to thereby produce the state in which the refrigerant is not allowed to flow the heat exchanger, the operation of the blow is continued, and the flammable refrigerant is dispersed to the exterior of the casing. Also, when the leakage of the flammable refrigerant has been detected during the operation stoppage, the compressor is kept in the stopped state or other action is taken to thereby produce a state in which refrigerant is not allowed to flow the heat exchanger, the blower is operated, and the flammable refrigerant is disperse to the exterior of the casing.

In this case, when the leakage of the flammable refrigerant has been detected, the flammable refrigerant can be rapidly dispersed to the exterior of the casing, and the concentration of the leaked flammable refrigerant is reduced to avoid reaching ignition conditions.

DESCRIPTION OF EMBODIMENTS

An embodiment of the air conditioning apparatus according to the present invention is described below with reference to the drawings. The specific configuration of embodiments of the air conditioning apparatus according to the present invention is not limited to the embodiment and modification examples thereof described below, and modifications are possible within a range that does not depart for the scope of the invention.

(1) Basic Configuration of the Air Conditioning Apparatus

<Overview>

Figure 1:
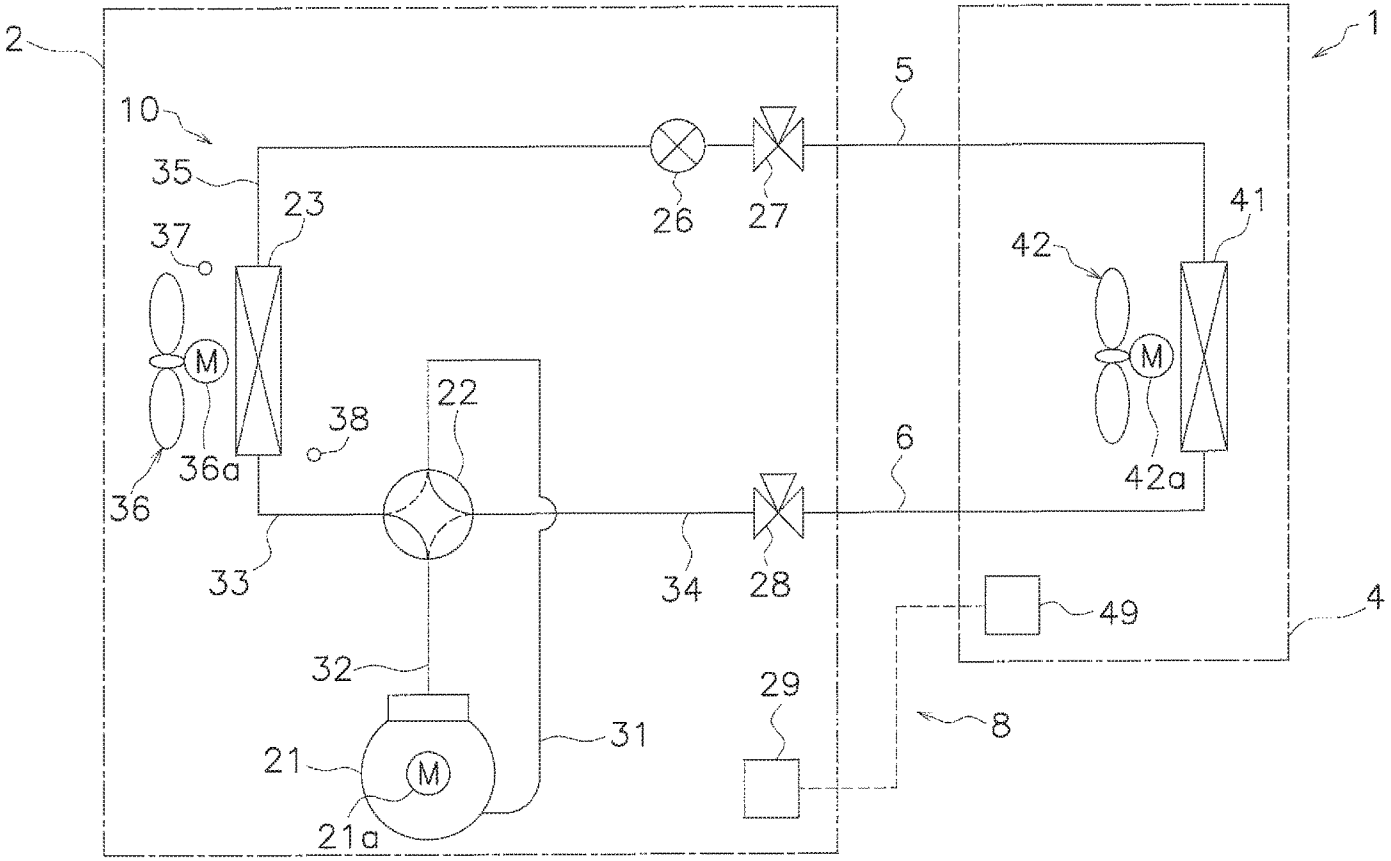
FIG. 1 is a schematic structural view of an air conditioning apparatus according to an embodiment of the present invention.

FIG. 1 is a schematic structural view of the air conditioning apparatus 1 according to an embodiment of the present invention.

The air conditioning apparatus 1 is used for air conditioning the indoors of a building or the like by a vapor-compression refrigerating cycle operation. The air conditioning apparatus 1 is mainly configured by an outdoor unit 2 and an indoor unit 4 being connected together. In this configuration, the outdoor unit 2 and the indoor unit 4 are connected via a liquid refrigerant communication pipe 5 and a gas refrigerant communication pipe 6. In other words, a vapor-compression refrigerant circuit 10 of the air conditioning apparatus 1 is configured by the outdoor unit 2 and the indoor unit 4 being connected together via the refrigerant communication pipes 5, 6. R32 or another refrigerant capable of ignition under specific conditions (hereinafter referred to as "flammable refrigerant") is sealed as a refrigerant in the refrigerant circuit 10.

<Indoor Unit>

The indoor unit 4 is disposed indoors and constitutes a portion of the refrigerant circuit 10. The indoor unit 4 mainly has an indoor heat exchanger 41.

The indoor heat exchanger 41 functions as an evaporator for the flammable refrigerant during an air-cooling operation to cool an indoor air, and functions as a radiator for the flammable refrigerant during an air-warming operation to heat the indoor air. The liquid side of the indoor heat exchanger 41 is connected to the liquid refrigerant communication pipe 5, and the gas side of the indoor heat exchanger 41 is connected to the gas refrigerant communication pipe 6.

The indoor unit 4 has an indoor fan 42 (blower) for taking the indoor air into the indoor unit 4, carrying out heat exchange between the flammable refrigerant and the indoor air taken into the indoor heat exchanger 41, and blowing out the heat-exchanged air to the exterior (i.e., indoors) of the indoor unit 4 as supplied air. In other words, the indoor unit 4 has an indoor fan 42 as a blower for supplying the indoor air to the indoor heat exchanger 41 as a heat source or cold source for the flammable refrigerant flowing through the indoor heat exchanger 41. In this case, a centrifugal fan, multiblade fan, or the like driven by an indoor fan motor 42*a* is used as the indoor fan 42 (blower).

The indoor unit 4 has an indoor-side control unit 49 for controlling the actuation of each component constituting the indoor unit 4. The indoor-side control unit 49 has a microcomputer, memory, and the like provided for controlling the indoor unit 4, and is configured so as to carry out interchange of control signals or the like with a remote control (not shown) for individually operating the indoor unit 4, and to carry out interchange of control signals or the like with the outdoor unit 2.

<Outdoor Unit>

The outdoor unit 2 is installed outdoors and constitutes a portion of the refrigerant circuit 10. The outdoor unit 2 mainly has a compressor 21, a four-way switching valve 22, an outdoor heat exchanger 23, an expansion valve 26, a liquid-side shutoff valve 27, and a gas-side shutoff valve 28.

The compressor 21 is a device for compressing the low-pressure flammable refrigerant in the refrigerating cycle to produce the high-pressure flammable refrigerant. The compressor 21 is a hermetic structure for rotatably driving a rotary-type, scroll-type, or other positive-displacement compression element (not shown) with the aid of the compressor motor 21*a*. The compressor 21 has an intake pipe 31 connected to the intake side and a discharge pipe 32 connected to the discharge side. The intake pipe 31 is a refrigerant pipe for connecting the intake side of the compressor 21 and the four-way switching valve 22. The discharge pipe 32 is a refrigerant pipe for connecting the discharge side of the compressor 21 and the four-way switching valve 22.

The four-way switching valve 22 switches the direction of the flow of the flammable refrigerant in the refrigerant circuit 10. During the air-cooling operation, the four-way switching valve 22 switches to an air-cooling cycle state for causing the outdoor heat exchanger 23 to function as a radiator of the flammable refrigerant compressed in the compressor 21, and for causing the indoor heat exchanger 41 to function as an evaporator of the flammable refrigerant which has radiated heat in the outdoor heat exchanger 23. In other words, during the air-cooling operation, the four-way switching valve 22 connects the discharge side (in this case, the discharge pipe 32) of the compressor 21 and the gas side (in this case, a first gas refrigerant pipe 33) of the outdoor heat exchanger 23 (see the solid line of the four-way switching valve 22 in FIG. 1). Also, the intake side (in this case, the intake pipe 31) of the compressor 21 and the gas refrigerant communication pipe 6 side (in this case, a second gas refrigerant pipe 34) are connected together (see the solid line of the four-way switching valve 22 in FIG. 1). During the air-warming operation, the four-way switching valve 22 switches to an air-warming cycle state for causing the outdoor heat exchanger 23 to function as an evaporator of the flammable refrigerant which has released heat in the indoor heat exchanger 41, and for causing the indoor heat exchanger 41 to function as a radiator of the flammable refrigerant compressed in the compressor 21. In other words, during the air-warming operation, the four-way switching valve 22 connects the discharge side (in this case, the discharge pipe 32) of the compressor 21 and the gas refrigerant communication pipe 6 side (in this case, a second gas refrigerant pipe 34) (see the broken line of the four-way switching valve 22 in FIG. 1). Also, the intake side (in this case, the intake pipe 31) of the compressor 21 and the gas side (in this case, the first gas refrigerant pipe 33) of the outdoor heat exchanger 23 are connected together (see the broken line of the four-way switching valve 22 in FIG. 11. The second gas refrigerant pipe 34 connects the four-way switching valve 22 and the gas-side shutoff valve 28.

The outdoor heat exchanger 23 functions as a radiator of the flammable refrigerant in which an outdoor air is used as a cold source during the air-cooling operation, and functions as a compressor of the flammable refrigerant when the outdoor air is used as a heat source during the air-warming operation. The liquid side of the outdoor heat exchanger 23 is connected to a liquid refrigerant pipe 35 and the gas side is connected to the first gas refrigerant pipe 33. The liquid refrigerant pipe 35 connects the liquid side of the outdoor heat exchanger 23 and the liquid refrigerant communication pipe 5 side.

During the air-cooling operation, the expansion valve 26 decompresses the high-pressure flammable refrigerant in the refrigerating cycle which has radiated heat in the outdoor heat exchanger 23 to the low pressure of the refrigerating cycle. During the air-warming operation, the expansion valve 26 decompresses the high-pressure flammable refrigerant in the refrigerating cycle which has radiated heat in the indoor heat exchanger 41 to the low pressure of the refrigerating cycle. The expansion valve 26 is provided to a portion of the liquid refrigerant pipe 35 nearer to a liquid-side shutoff valve 27. In this case, an electrical expansion valve is used as the expansion valve 26.

The liquid-side shutoff valve 27 and the gas-side shutoff valve 28 are provided to the connection ports of the exterior devices and pipes specifically, the liquid refrigerant communication pipe 5 and the gas refrigerant communication pipe 6). The liquid-side shutoff valve 27 is provided to an end section of the liquid refrigerant pipe 35. The gas-side shutoff valve 28 is provided to an end section of the second gas refrigerant pipe 34.

The outdoor unit 2 has an outdoor fan 36 (blower) for taking the outdoor air into the outdoor unit 2, carrying out heat exchange between the flammable refrigerant and the outdoor air taken into the outdoor heat exchanger 23, and blowing out the heat-exchanged air to the exterior (i.e., outdoors) of the outdoor unit 2 as expelled air. In other words, the outdoor unit 2 has an outdoor fan 36 serving as a blower for supplying the outdoor air to the outdoor heat exchanger 23 as a heat source or cold source for the flammable refrigerant flowing through the outdoor heat exchanger 23. In this case, a propeller fan driven by an outdoor fan motor 36*a* is used as the outdoor fan 36 (blower).

The outdoor unit 2 has an outdoor-side control unit 29 for controlling the actuation of each component constituting the outdoor unit 2. The outdoor-side control unit 29 has a microcomputer, memory, and/or an inverter device or the like for controlling the compressor motor 21*a* provided for controlling the outdoor unit 2, and is configured so as to carry out interchange of control signals or the like with the indoor-side control unit 49 of the indoor unit 4. Refrigerant sensors 37, 38 for detecting the flammable refrigerant are provided to the outdoor unit 2, and the details of arrangement or the like of the refrigerant sensors 37, 38 are described later.

<Refrigerant Communication Pipes>

The refrigerant communication pipes 5, 6 are installed on site when the air conditioning apparatus 1 is set up in a building or other installation location, and pipes having various lengths and/or diameters are used in accordance with the installation location and/or installation conditions such as the combination of the outdoor unit and the indoor unit.

<Control Unit>

Figure 2:
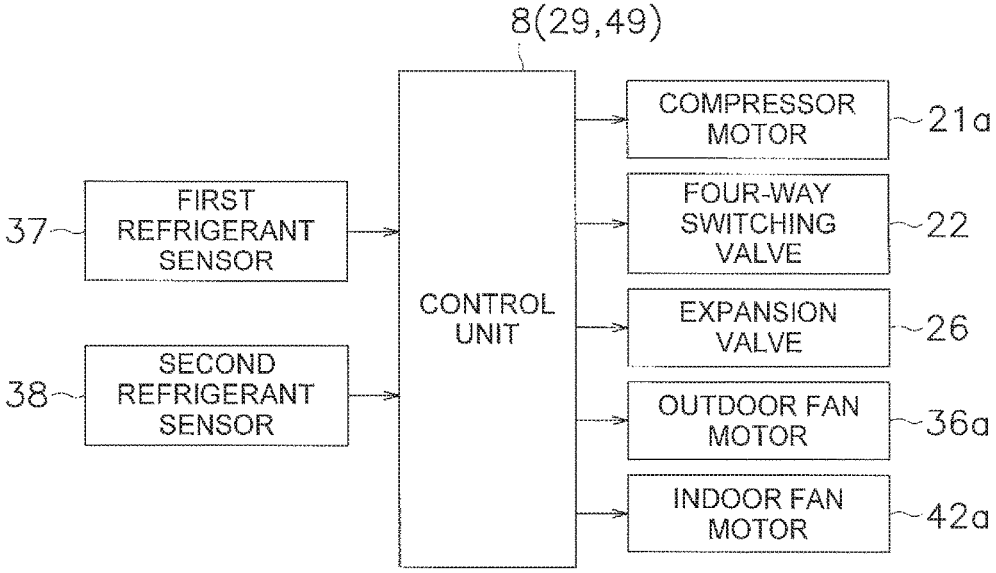
FIG. 2 is a control block diagram of the air conditioning apparatus.

The indoor-side control unit 49 of the indoor unit 4 and the outdoor-side control unit 29 of the outdoor unit 2 constitute a control unit 8 for controlling the operation of the air conditioning apparatus 1 overall, as shown in FIG. 1. The control unit 8 is connected so as to be capable of receiving the detection signals of various sensors including the refrigerant sensors 37, 38, as shown in FIG. 2. The control unit 8 is configured so as to be capable of carrying out the air-cooling operation, air-warming operation, and various other operations by controlling the various devices and valves 21*a*, 22, 26, 36*a*, 42*a* on the basis of the detection signals or the like. 2 is a control block diagram of the air conditioning apparatus 1.

As described above, the air conditioning apparatus 1 has a refrigerant circuit 10 configured by the indoor unit 4 being connected to the outdoor unit 2 via the refrigerant communication pipes 5, 6, R32 or another flammable refrigerant is sealed as a refrigerant in the refrigerant circuit 10. The air conditioning apparatus 1 has the outdoor heat exchanger 23 serving as a heat exchanger and the outdoor fan 36 serving as a blower in the outdoor unit 2, and has the indoor heat exchanger 41 as a heat exchanger and the indoor fan 42 as a blower in the indoor unit 4. In the air conditioning apparatus 1, the operation and control are carried out by the control unit 8 in the following manner.

(2) Basic Actuation of the Air Conditioning Apparatus

The basic actuation of the operations (the air-cooling operation and the air-warming operation) of the air conditioning apparatus 1 is next described with reference to FIG. 1.

<Air-Cooling Operation>

When the air-cooling operation instruction has been given from the remote control or the like (not shown), the four-way switching valve 22 is switched to the air-cooling cycle state (the state indicated by the solid line of four-way switching valve 22 in FIG. 1), and the compressor 21, the outdoor fan 36, and the indoor fan 42 are started up.

At this time, the flammable refrigerant in the low-pressure gas state in the refrigerant circuit 10 is taken into the compressor 21 and compressed to become the flammable refrigerant in the high-pressure gas state. The flammable refrigerant in the high-pressure gas state is sent to the outdoor heat exchanger 23 (heat exchanger) by way of the four-way switching valve 22. The flammable refrigerant in the high-pressure gas state sent to the outdoor heat exchanger 23 is condensed by heat exchange with the outdoor air fed by the outdoor fan 36 (blower) to be cooled and become the flammable refrigerant in the high-pressure liquid state in the outdoor heat exchanger 23, which functions as a radiator for the flammable refrigerant. The flammable refrigerant in the high-pressure liquid state is decompressed by the expansion valve 26 to become the low-pressure flammable refrigerant in the gas-liquid two-phase state. The low-pressure flammable refrigerant in the gas-liquid two-phase state is sent from the outdoor unit 2 to the indoor unit 4 by way of the liquid refrigerant communication pipe 5.

The low-pressure flammable refrigerant in the gas-liquid two-phase state sent to the indoor unit 4 is sent to the indoor heat exchanger 41 (heat exchanger). The low-pressure flammable refrigerant in the gas-liquid two-phase state sent to the indoor heat exchanger 41 is evaporated by heat exchange with the indoor air fed by the indoor fan 42 (blower) to be heated and become the low-pressure flammable refrigerant in the gas state in the indoor heat exchanger 41, which functions as an evaporator of the flammable refrigerant. The low-pressure flammable refrigerant in the gas state is sent from the indoor unit 4 to the outdoor unit 2 by way of the gas refrigerant communication pipe 6.

The low-pressure flammable refrigerant in the gas state sent to the outdoor unit 2 is again taken into the compressor 21 by way of the four-way switching valve 22.

<Air-Warming Operation>

When the air-warming operation instruction has been given from the remote control or the like (not shown), the four-way switching valve 22 is switched to the air-warming cycle state (the state indicated by the broke line of four-way switching valve 22 in FIG. 1), and the compressor 21, the outdoor fan 36, and the indoor fan 42 are started up.

At this time, the flammable refrigerant in the low-pressure gas state in the refrigerant circuit 10 is taken into the compressor 21 and compressed to become the flammable refrigerant in the high-pressure gas state. The flammable refrigerant in the high-pressure gas state is sent from the outdoor unit 2 to the indoor unit 4 by way of the four-way switching valve 22 and the gas refrigerant communication pipe 6.

The flammable refrigerant in the high-pressure gas state sent to the indoor unit 4 is sent to the indoor heat exchanger 41 (heat exchanger). The flammable refrigerant in the high-pressure gas state sent to the indoor heat exchanger 41 is condensed by heat exchange with the indoor air fed by the indoor fan 42 (blower) to be cooled and become the flammable refrigerant in the high-pressure liquid state in the indoor heat exchanger 41, which functions as a radiator for the flammable refrigerant. The flammable refrigerant in the high-pressure liquid state is sent from the indoor unit 4 to the outdoor unit 2 by way of the liquid refrigerant communication pipe 5.

The flammable refrigerant in the high-pressure liquid state sent to the indoor unit is decompressed by the expansion valve 26 to become the low-pressure flammable refrigerant in the gas-liquid two-phase state. The low-pressure flammable refrigerant in the gas-liquid two-phase state is sent to the outdoor heat exchanger 23 (heat exchanger). The low-pressure flammable refrigerant in the gas-liquid two-phase state thusly sent to the outdoor heat exchanger 23 is evaporated by heat exchange with the outdoor air fed by the outdoor fan 36 (blower) to be heated and become the low-pressure flammable refrigerant in the gas state in the outdoor heat exchanger 23, which functions as an evaporator of the flammable refrigerant. The low-pressure flammable refrigerant in the gas state is again taken into the compressor 21 by way of the four-way switching valve 22.

(3) Structure of the Outdoor Unit, Arrangement of the Refrigerant Sensors, and Control for Dispersing the Flammable Refrigerant to the Apparatus Exterior <Structure of the Outdoor Unit>

Figure 3:
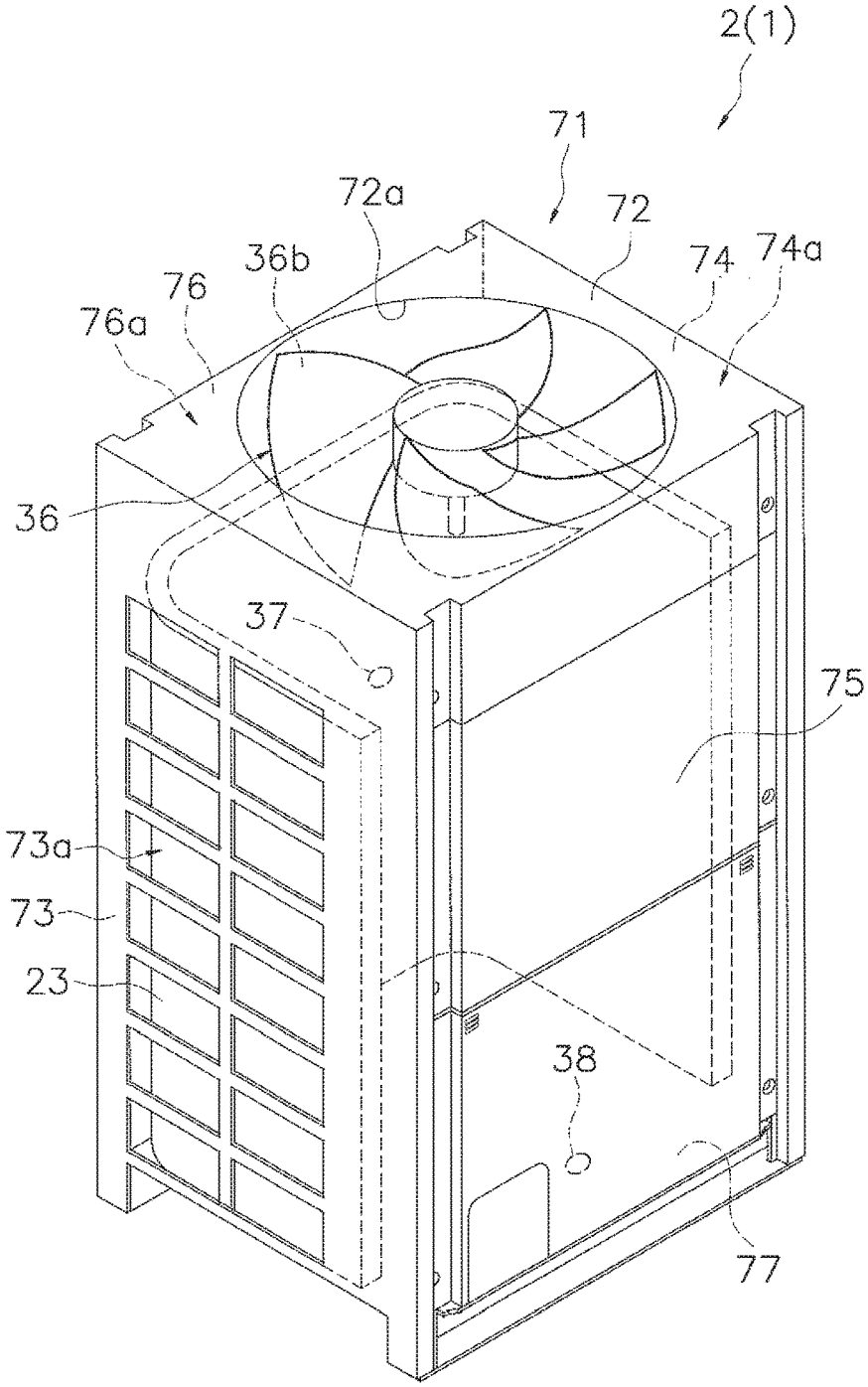
FIG. 3 is a schematic perspective view (with a fan grill removed) of an outdoor unit.
Figure 4:
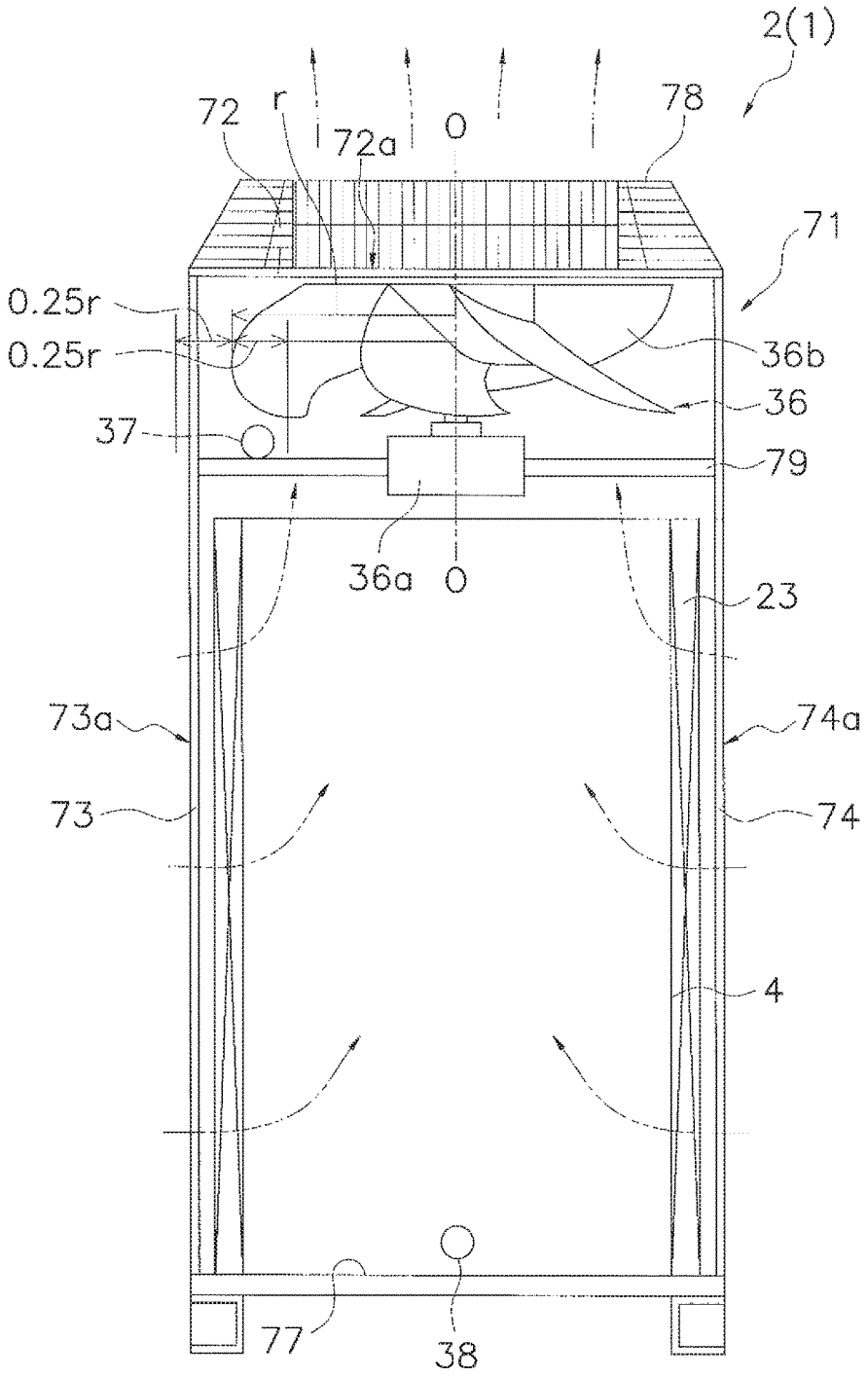
FIG. 4 is a front view (with a front panel removed) of the outdoor unit.

The structure of the outdoor unit 2 constituting the air conditioning apparatus 1 is next described with reference to FIGS. 1 to 4. FIG. 3 is a schematic perspective view (with a fan grill 78 removed) of the outdoor unit 2, and FIG. 4 is a front view (with a front panel 75 removed) of the outdoor unit 2. "Front," "rear," "left," and "right" in the description below is based on viewing the outdoor unit 2 from the front panel 75 side. In FIGS. 3 and 4, components other than the outdoor heat exchanger 23 and the outdoor fan 36 are omitted from the drawings.

The outdoor unit 2 has a top-blow-type structure in which the air is taken into the casing 71 from below and the air is blown to the exterior of the casing 71 from above.

The casing 71 in this example is a substantially rectangular parallelepiped-shaped box, and mainly has a top surface panel 72 constituting a top surface section of the casing 71, a left-side surface panel 73, a right-side surface panel 74, the front-side surface panel 75, and a rear-side surface panel 76 constituting side surface sections of the casing 71, and a bottom surface panel 77 constituting the bottom surface section of the casing 71. The top surface panel 72 is a member constituting the top surface section of the casing 71, and is mainly a panel-shaped member having a substantially rectangular shape as viewed from above and in which a blow-off port **72*a* is formed substantially in the center. The fan grill 78 is formed in the top surface panel 72 so as to cover the blow-off port 72*a* from above. The left-side surface panel 73 is mainly a member constituting the left-side surface section of the casing 71, and is a panel-shaped member having a substantially rectangular shape as viewed from the side and which extends downward from the left edge of the top surface panel 72. Intake ports 73*a* are formed in essentially the entire left-side surface panel 73 excluding the upper section. The right-side surface panel 74 is mainly a member constituting the right-side surface section of the casing 71, and is a panel-shaped member having a substantially rectangular shape as viewed from the side and which extends downward from the right edge of the top surface panel 72. Intake ports 74***a* are formed in essentially the entire right-side surface panel 74 excluding the upper section. The front-side surface panel 75 is mainly a member constituting the front-side surface section of the casing 71, and is a panel-shaped member having a substantially rectangular shape as viewed from the side and which is arranged in sequence downward from the front edge of the top surface panel 72. The rear-side surface panel 76 is mainly a member constituting the rear-side surface section of the casing 71, and is a panel-shaped member having a substantially rectangular shape as viewed from the side and which is arranged in sequence downward from the rear edge of the top surface panel 72. Intake ports 76*a* are formed in essentially the entire rear-side surface panel 76 excluding the upper section. The bottom surface panel 77 is mainly a member constituting the bottom surface section of the casing 71, and is a panel-shaped member having a substantially rectangular shape as viewed from above. In other words, the intake ports 73*a*, 74*a*, 76*a* and the blow-off port 72*a* are formed in the casing 71. In this example, the blow-off port 72*a* is formed in the top surface section (in this example, the top surface panel 72) of the casing 71, and the intake ports 73*a*, 74*a*, 76*a* are formed in the side surface sections (in this example, the left-side surface panel 73, the right-side surface panel 74, the front-side surface panel 75, and the rear-side surface panel 76) of the casing 71 below the blow-off port 72*a*. In this example, the blow-off port 72*a* is formed as an opening that faces upward in the top surface panel 72 constituting the top surface section of the casing 71, but no limitation is imposed thereby. For example, the blow-off port 72*a* may be formed as an opening that faces laterally in the upper section of the side surface panels 73 to 76 constituting the side surface sections of the casing 71. In such case, the upper sections of the side surface panels 73 to 76 would also constitute the top surface section of the casing 71.

Such a casing 71 houses various components including the outdoor heat exchanger 23 serving as a heat exchanger and the outdoor fan 36 serving as a blower. The air conditioning apparatus 1 is configured so that the outdoor fan 36 serving as a blower is caused to rotate while the flammable refrigerant is allowed to flow to the outdoor heat exchanger 23 serving as a heat exchanger during the above-described air-cooling operation, air-warming operation, and/or other operations in the outdoor unit 2, the air (in this example, the outdoor air) is taken from the intake ports 73*a*, 74*a*, 76*a* into the casing 71, a heat is exchanged between the flammable refrigerant and the air (in this example, the outdoor air) taken into the outdoor heat exchanger 23 serving as a heat exchanger, and the heat-exchanged air (in this example, outdoor air) is blown out from the blow-off port 72*a* to the exterior of the casing 71. In this case, the outdoor heat exchanger 23 serving as a heat exchanger is substantially U-shaped as viewed from above, and is arranged to as to face the intake ports 73*a*, 74*a*, 76*a*. In this example, the outdoor fan 36 serving as a blower is arranged on the downwind side of the outdoor heat exchanger 23 serving as a heat exchanger and above the outdoor heat exchanger 23. The outdoor fan 36 serving as a blower has a propeller-type impeller 36*b*, and the outdoor fan motor 36*a* for rotatably driving the propeller-type impeller 36*b*. The outdoor fan motor 36*a* is supported by the casing 71 via a motor support base 79, and the propeller-type impeller 36*b* is connected to a rotating shaft extending upward from the outdoor fan motor 36*a* along the rotational axis O-O.

<Arrangement of the Refrigerant Sensors>

In the air conditioning apparatus 1 that uses R32 or other flammable refrigerant, the flammable refrigerant is liable to leak during the operation in the outdoor unit 2. For example, there may be cases in which abnormal vibrations occur due to a failure of the compressor 21 or other cause, and heat transfer tubes and/or refrigerant pipes of the outdoor heat exchanger 23 serving as a heat exchanger are damaged. Accordingly, it is preferred that refrigerant sensors for detecting the leakage of the flammable refrigerant be provided to the air conditioning apparatus 1 as conventionally proposed.

However, in a conventional refrigerant sensor arrangement, the flammable refrigerant is dispersed by the flow of the air from the blower during the operation of the air conditioning apparatus and it is possible that the leakage of the flammable refrigerant cannot be rapidly detected.

In view of the above, first, in this example, the first refrigerant sensor 37 for detecting the flammable refrigerant is provided on the downwind side of the outdoor heat exchanger 23 serving as a heat exchanger inside the casing 71, as shown in FIGS. 3 and 4. The reason for providing the first refrigerant sensor 37 for detecting the flammable refrigerant on the downwind side of the outdoor heat exchanger 23 serving as a heat exchanger inside the casing 71 is that a refrigerant sensor is preferably arranged in a position where the flow of the air (in this example, the outdoor air) from the outdoor fan 36 serving as a blower is concentrated inside the casing 71 and where the majority of the leaked flammable refrigerant would pass so that the leakage of flammable refrigerant can be rapidly detected during the operation.

In accordance with the foregoing, the leakage of the flammable refrigerant during the operation (the air-cooling operation and/or the air-warming operation or the like) can be rapidly detected. The flammable refrigerant has a high specific gravity and therefore tends to readily accumulate in the vicinity of the bottom surface section (bottom surface panel 77) of the casing 71. Accordingly, the leakage of the flammable refrigerant during the operation (the air-cooling operation and/or the air-warming operation or the like) may not be rapidly detected when the first refrigerant sensor 37 is arranged in the position other than the downwind side of the outdoor heat exchanger 23 such as in the vicinity of the bottom surface section (bottom surface panel 77) of the casing 71. However, in this example, the first refrigerant sensor 37 is arranged in the position on the downwind side of the outdoor heat exchanger 23 in the vicinity of the top surface section (in this example, the top surface panel 72) of the casing 71, and concentrating the flow of the air during the operation (the air-cooling operation and/or the air-warming operation or the like) makes it possible to rapidly detect the leakage of the flammable refrigerant.

In this example, the first refrigerant sensor 37 is arranged so as to be on the upwind side of the outdoor fan 36 serving as a blower, as shown in FIGS. 3 and 4. In other words, the outdoor heat exchanger 23 serving as a heat exchanger and the outdoor fan 36 serving as a blower are arranged in the sequence of the outdoor heat exchanger 23 serving as a heat exchanger and the outdoor fan 36 serving as a blower with respect to the flow of the air (in this example, the outdoor air) in the casing 71, and the first refrigerant sensor 37 is arranged on the downwind side of the outdoor heat exchanger 23 serving as a heat exchanger and on the upwind side of the outdoor fan 36 serving as a blower. Accordingly, detection of the flammable refrigerant by the first refrigerant sensor 37 can be made less likely to be affected by the atmosphere outside the casing 71 and in which the flammable refrigerant has been dispersed (in this case, the atmosphere outside the casing 71 through the blow-off port 72*a*). In this example, the first refrigerant sensor 37 is attached to the motor support base 79.

It is thereby possible to increase the precision for detecting the leakage of the flammable refrigerant.

Also, in this example, the first refrigerant sensor 37 is arranged in the position nearer to the outdoor fan 36 (specifically, the propeller-type impeller 36*b*) serving as a blower than to the outdoor heat exchanger 23 serving as a heat exchanger, as shown in FIG. 4. Accordingly, it is thereby possible to improve the degree of concentration of the flow of the air (in this example, the outdoor air) from the outdoor fan 36 serving as a blower in comparison with when the first refrigerant sensor 37 is arranged in the position near the outdoor heat exchanger 23 serving as a heat exchanger.

It is thereby possible to increase the precision for detecting the leakage of the flammable refrigerant.

Also, in this example, the first refrigerant sensor 37 is arranged in the vicinity of the external peripheral edge of the propeller-type impeller 36*b* constituting the outdoor fan 36 serving as a blower, as shown in FIG. 4. The first refrigerant sensor 37 is preferably arranged within a range of 0.25 r to the internal peripheral side from the external peripheral edge (i.e., the position in the circumferential direction of the radius r) of the propeller-type impeller 36*b*, where r is the radius of the propeller-type impeller 36*b* as viewed from above. Alternatively, the first refrigerant sensor 37 is preferably arranged within a range of 0.25 r to the external peripheral side from the external peripheral edge (i.e., the position in the circumferential direction of the radius r) of the propeller-type impeller 36*b*. In this example, the first refrigerant sensor 37 is arranged within a range of 0.25 r to the internal peripheral side from the external peripheral edge (i.e., the position in the circumferential direction of the radius r) of the propeller-type impeller 36*b*. Accordingly, the detection of the flammable refrigerant by the first refrigerant sensor 37 can be carried out in the position in which the velocity of the air (in this example, the outdoor air) inside the casing 71 is greatest.

It is thereby possible to increase the precision for detecting the leakage of the flammable refrigerant.

In the air conditioning apparatus 1, the leakage of the flammable refrigerant is also liable to occur during the operation stoppage in the outdoor unit 2. For example, there are cases in which the flammable refrigerant has leaked during the operation and the operation has stopped with the situation unchanged, or the heat transfer tubes and/or refrigerant pipes of the outdoor heat exchanger 23 serving as a heat exchanger are damaged during transport, delivery, and installation work.

However, in this example, the structure is used in which the blow-off port 72*a* is formed in the top surface section (in this example, the top surface panel 72) of the casing 71, and the intake ports 73*a*, 74*a*, 76*a* are formed in the side surface sections (the left-side surface panel 73, right-side surface panel 74, front-side surface panel 75, and rear-side surface panel 76) of the casing 71 below the blow-off port 72*a*, i.e., the top-blow-type structure in which the air (in this example, the outdoor air) is taken into the casing 71 from below and the air (in this example, the outdoor air) is blown to the exterior of the casing 71 from above. Accordingly, when the flammable refrigerant has leaked during the operation stoppage, the flammable refrigerant, which has a high specific gravity, accumulates in the vicinity of the bottom surface section (the bottom surface panel 77) of the casing 71, and the first refrigerant sensor 37 provided on the downwind side of the outdoor heat exchanger 23 serving as a heat exchanger is not able to rapidly detect the leakage of the flammable refrigerant during the operation stoppage.

In view of this situation, in this example, the second refrigerant sensor 38 is furthermore provided to the bottom surface section of the casing 71 (in the vicinity of the bottom surface panel 77) when the casing 71 having the top-blow-type structure is used, as shown in FIGS. 3 and 4. In this example, the second refrigerant sensor 38 is arranged in the position slightly above the bottom surface panel 77.

The leakage of the flammable refrigerant during the operation stoppage can thereby be rapidly detected.

<Control for Dispersing the Flammable Refrigerant to the Apparatus Exterior>

When the leakage of the flammable refrigerant has been detected by the first refrigerant sensor 37 and/or the second refrigerant sensor 38 described above, the flammable refrigerant is preferably rapidly dispersed to the exterior of the casing 71 and the concentration of the leaked flammable refrigerant is reduced so as to avoid reaching ignition conditions.

In view of the above, in this example, when the first refrigerant sensor 37 and/or the second refrigerant sensor 38 has detected the flammable refrigerant, the control for dispersing the flammable refrigerant to the apparatus exterior is carried out in which the outdoor fan 36 serving as a blower is caused to rotate in a state in which the flammable refrigerant is not allowed to flow to the outdoor heat exchanger 23 serving as a heat exchanger.

Figure 5:
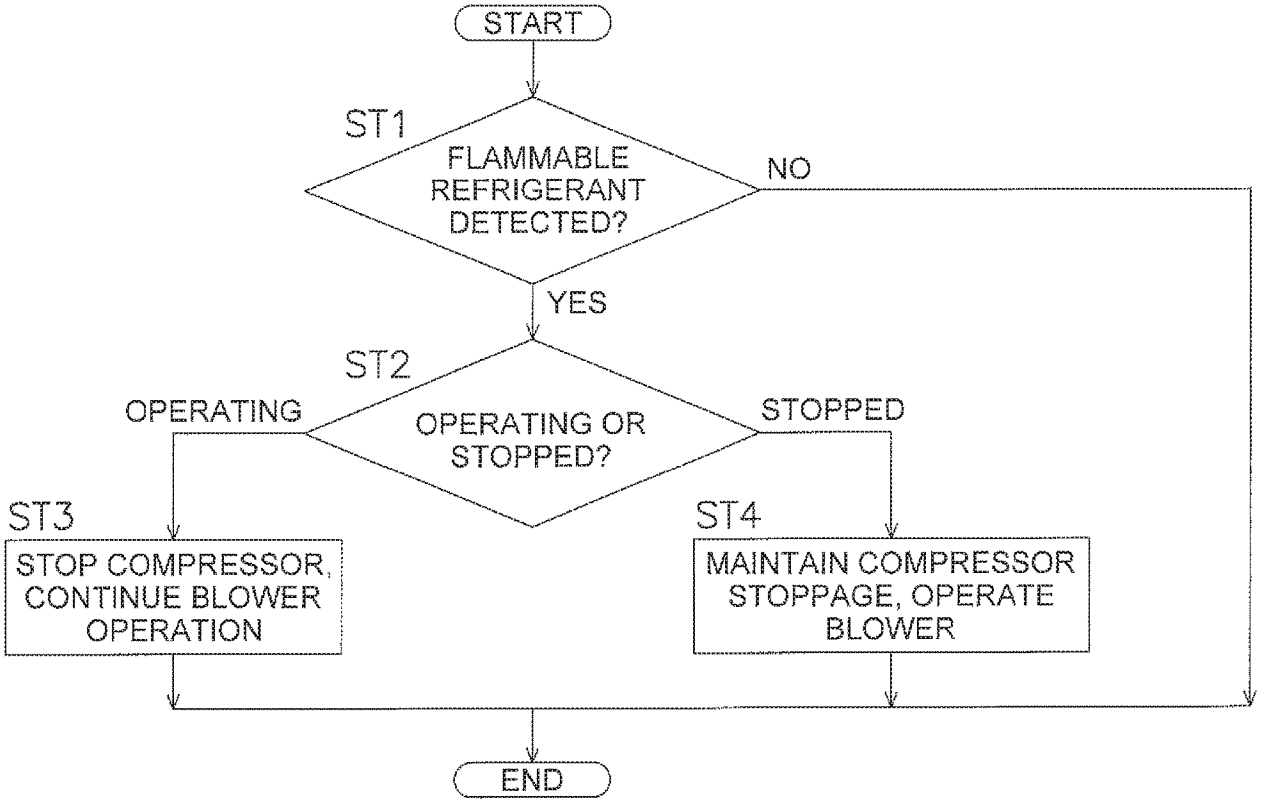
FIG. 5 is a flowchart for controlling a dispersion of a flammable refrigerant to the apparatus exterior.

The control for dispersing the flammable refrigerant to the apparatus exterior is next described with reference to FIGS. 1 to 5. FIG. 5 is a flowchart of the control for dispersing the flammable refrigerant to the apparatus exterior. The control for dispersing the flammable refrigerant to the apparatus exterior is carried out by the control unit 8.

Specifically, first, in step ST1, it is determined whether the first refrigerant sensor 37 and/or the second refrigerant sensor 38 has detected the flammable refrigerant. During the operation, it is highly likely that it is the first refrigerant sensor 37 that detects the flammable refrigerant, and during the operation stoppage, it is highly likely that it is the second refrigerant sensor 38 that detects the flammable refrigerant. When the flammable refrigerant has been detected in step ST1, the process proceeds to step ST2.

Next, in step ST2, it is determined whether the current state of the air conditioning apparatus 1 is operating or stoppage. When the current state of the air conditioning apparatus 1 is an operating state in step ST2, the process proceeds to step ST3, and when the current state of the air conditioning apparatus 1 is a stopped state, the process proceeds to step ST4.

Next, in step ST3, the outdoor fan 36 serving as a blower is caused to rotate in a state in which the flammable refrigerant is not allowed to flow to the outdoor heat exchanger 23 serving as a heat exchanger. Specifically, the compressor 21 is stopped or other action is taken to yield a state in which the refrigerant is not allowed to flow to the outdoor heat exchanger 23 serving as a heat exchanger and the operation of the outdoor fan 36 serving as a blower is continued. The flammable refrigerant can thereby be dispersed to the exterior of the casing 71. At this time, the outdoor fan 36 is preferably operated at maximum speed in order to accelerate the dispersion of the flammable refrigerant. In step ST4 as well, the outdoor fan 36 serving as a blower is caused to rotate in a state in which the flammable refrigerant is not allowed to flow to the outdoor heat exchanger 23 serving as a heat exchanger. Specifically, the stoppage of the compressor 21 is maintained or other action is taken to form a state in which the refrigerant is not allowed to flow to the outdoor heat exchanger 23 serving as a heat exchanger and the operation of the outdoor fan 36 serving as a blower is carried out. The flammable refrigerant can thereby be dispersed to the exterior of the casing 71. At this time as well, the outdoor fan 36 is preferably operated at maximum speed in order to accelerate the dispersion of the flammable refrigerant.

(4) Modifications

<A>

In the embodiment described above, the outdoor heat exchanger 23 serving as a heat exchanger is substantially U-shaped as viewed from above, but no limitation is imposed thereby. For example, the heat exchanger may have another shape such as substantially V-shaped as viewed from the side.

<B>

Described in the embodiment above and modification thereof were examples in which the refrigerant sensors 37, 38 are provided to the outdoor unit 2, but no limitation is imposed thereby. For example, the refrigerant sensors 37, 38 may be provided to the indoor unit 4. For example, it is possible to use the same arrangement of the refrigerant sensors 37, 38 of the present invention when the indoor unit 4 is a floor-type indoor unit having a structure in which an air (in this case, the indoor air) is taken into a casing from below and the air (in this case, the indoor air) is blown out to the exterior of the case from above.

<C>

Described in the embodiment above and modifications thereof were examples in which the refrigerant circuit 10 of the air conditioning apparatus 1 can be switched between the air-cooling operation and the air-warming operation by a four-way switching valve 22, but no limitation is imposed thereby. For example, the present invention can be applied to an air conditioning apparatus having a refrigerant circuit dedicated to the air-cooling operation or to the air-warming operation.

INDUSTRIAL APPLICABILITY

The present invention can be widely applied to air conditioning apparatuses in which a flammable refrigerant is used.

What is claimed is:

1. An air conditioning apparatus a casing in which an intake port is formed in a side surface section and a blow-off port is formed in a top surface section;

a heat exchanger housed in the casing; and a blower housed in the casing, the blower being caused to rotate while a flammable refrigerant flows to the heat exchanger during an operation, an intake air being taken into the casing from the intake port, a heat exchange being carried out between the flammable refrigerant and the intake air in the heat exchanger, and the heat-exchanged air being blown out from the blow-off port to an exterior of the casing, a first refrigerant sensor arranged to detect the flammable refrigerant being disposed on a downwind side of the heat exchanger inside the casing, the blower being arranged on the downwind side of the heat exchanger, and the first refrigerant sensor being arranged in a position nearer to the blower than to the heat exchanger.

2. The air conditioning apparatus according to claim 1, wherein the blower is arranged on the downwind side of the heat exchanger, and the first refrigerant sensor is arranged on an upwind side of the blower.

3. The air conditioning apparatus according to claim 2, wherein the blower has a propeller impeller, and the first refrigerant sensor is arranged adjacent an external peripheral edge of the impeller.

4. The air conditioning apparatus according to claim 2, wherein the intake port is formed below the blow-off port along the side surface section of the casing, and a second refrigerant sensor arranged to detect that the flammable refrigerant is disposed at a bottom surface section of the casing.

5. The air conditioning apparatus according to claim 2, wherein when the first refrigerant sensor has detected the flammable refrigerant, the blower is caused to rotate in a state in which the compressor is stopped so that the flammable refrigerant is not allowed to flow to the heat exchanger.

6. The air conditioning apparatus according to claim 1, wherein the blower has a propeller impeller, and the first refrigerant sensor is arranged adjacent an external peripheral edge of the impeller.

7. The air conditioning apparatus according to claim 1, wherein the intake port is formed below the blow-off port along the side surface section of the casing, and a second refrigerant sensor arranged to detect that the flammable refrigerant is disposed at a bottom surface section of the casing.

8. The air conditioning apparatus according to claim 7, wherein when the first refrigerant sensor or the second refrigerant sensor has detected the flammable refrigerant, the blower is caused to rotate in a state in which the compressor is stopped so that the flammable refrigerant is not allowed to flow to the heat exchanger.

9. The air conditioning apparatus according to claim 1, wherein when the first refrigerant sensor has detected the flammable refrigerant, the blower is caused to rotate in a state in which the compressor is stopped so that the flammable refrigerant is not allowed to flow to the heat exchanger.

10. The air conditioning apparatus according to claim 1, wherein the first refrigerant sensor is arranged in the position nearer to the blower than to the heat exchanger along an air flow from the intake port to the blow-off port.

11. An air conditioning apparatus a casing in which an intake port is formed in a side surface section and a blow-off port is formed in a top surface section;

a heat exchanger housed in the casing; and a blower housed in the casing, the blower being caused to rotate while a flammable refrigerant flows to the heat exchanger during an operation an intake air being taken into the casing from the intake port, a heat exchange being carried out between the flammable refrigerant and the intake air in the heat exchanger, and the heat-exchanged air being blown out from the blow-off port to an exterior of the casing, a first refrigerant sensor arranged to detect the flammable refrigerant being disposed on a downwind side of the heat exchanger inside the casing, the blower having a propeller impeller, and the first refrigerant sensor being arranged adjacent an external peripheral edge of the impeller.

12. The air conditioning apparatus according to claim 11, wherein the intake port is formed below the blow-off port along the side surface section of the casing, and a second refrigerant sensor arranged to detect that the flammable refrigerant is disposed at a bottom surface section of the casing.

13. The air conditioning apparatus according to claim 12, wherein when the first refrigerant sensor or the second refrigerant sensor has detected the flammable refrigerant, the blower is caused to rotate in a state in which the compressor is stopped so that the flammable refrigerant is not allowed to flow to the heat exchanger.

14. The air conditioning apparatus according to claim 5, wherein when the first refrigerant sensor has detected the flammable refrigerant, the blower is caused to rotate in a state in which the compressor is stopped so that the flammable refrigerant is not allowed to flow to the heat exchanger.

15. The air conditioning apparatus according to claim 5, wherein the first refrigerant sensor is arranged within a range of 0.25r to the internal peripheral side from the external peripheral edge or within a range of 0.25r to the external peripheral side from the external peripheral edge, where r is a radius of the impeller as viewed from above.

* * * * *